US010363753B2

(12) United States Patent
Maruyama

(10) Patent No.: US 10,363,753 B2
(45) Date of Patent: Jul. 30, 2019

(54) LIQUID EJECTING APPARATUSES

(71) Applicant: SEIKO EPSON CORPORATION, Tokyo (JP)

(72) Inventor: Akihiko Maruyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/973,142

(22) Filed: May 7, 2018

(65) Prior Publication Data

US 2018/0326739 A1 Nov. 15, 2018

(30) Foreign Application Priority Data

May 10, 2017 (JP) ..... 2017-093697

(51) Int. Cl.
*B41J 2/175* (2006.01)
*B41J 2/18* (2006.01)
*B41J 29/13* (2006.01)

(52) U.S. Cl.
CPC ..... *B41J 2/17596* (2013.01); *B41J 2/175* (2013.01); *B41J 2/1752* (2013.01); *B41J 2/17509* (2013.01); *B41J 2/17566* (2013.01); *B41J 29/13* (2013.01); *B41J 2002/17586* (2013.01)

(58) Field of Classification Search
CPC ..... B41J 2/18; B41J 2/17596; B41J 2/17509; B41J 2/1752; B41J 2/17566
See application file for complete search history.

(56) References Cited

U.S. PATENT DOCUMENTS

2007/0291086 A1 12/2007 Murakami et al.
2010/0073444 A1 3/2010 Sato
2010/0085396 A1* 4/2010 Yokota ..... B41J 2/14233 347/7
2011/0242156 A1* 10/2011 Shimoda ..... B41J 2/175 347/6
2012/0206547 A1 8/2012 Shirotori
2013/0286114 A1 10/2013 Ito et al.
2015/0224786 A1* 8/2015 Otsuka ..... B41J 2/17596 347/92

FOREIGN PATENT DOCUMENTS

JP 2007-331281 A 12/2007
JP 2010-076206 A 4/2010
JP 2011-255643 A 12/2011
JP 2012-166473 A 9/2012
JP 2013-226735 A 11/2013
JP 2013-240984 A 12/2013

* cited by examiner

*Primary Examiner* — Jason S Uhlenhake
(74) *Attorney, Agent, or Firm* — Workman Nydegger

(57) ABSTRACT

A liquid ejecting apparatus includes a liquid ejecting head that ejects liquid, and a supply device that supplies the liquid from a liquid supply source to the liquid ejecting head, the supply device including a first liquid supplying flow path that supplies the liquid, a pump that feeds the liquid, a second liquid supplying flow path having one end connected to an upstream connecting portion and the other end connected to a downstream connecting portion, a pressure control valve disposed in the second liquid supplying flow path, a buffer in which a volume of a storage chamber varies by displacement of a flexible member, and a pressure applying section that applies pressure to the flexible member from an outside of the storage chamber.

9 Claims, 6 Drawing Sheets

LIQUID EJECTING APPARATUSES

BACKGROUND

1. Technical Field

The present invention relates to liquid ejecting apparatuses such as printers.

2. Related Art

As an example of the liquid ejecting apparatus, there are ink jet printers that perform printing by ejecting ink (liquid) supplied from an ink cartridge (liquid supply source) onto a paper sheet via a liquid ejecting head. Such printers include a liquid supplying path (liquid supplying flow path) for supplying ink from the ink cartridge to the liquid ejecting head, and the liquid supplying path is provided with a pump that feeds ink and a buffer that temporarily stores the ink pumped from the pump. JP-A-2012-166473 is an example of related art.

The buffer is located between the pump and the liquid ejecting head in the liquid supplying path, and supplies the temporarily stored ink to the liquid ejecting head in line with ink consumption in the liquid ejecting head. Accordingly, if the amount of ink fed by the pump is larger than the amount of ink ejected from the liquid ejecting head, there is a risk that the pressure in the buffer becomes too high.

SUMMARY

An advantage of some aspects of the invention is that a liquid ejecting apparatus that can limit an increase in pressure in a buffer is provided.

According to an aspect of the invention, a liquid ejecting apparatus includes a liquid ejecting head that ejects liquid, and a supply device that supplies the liquid from a liquid supply source to the liquid ejecting head, the supply device including a first liquid supplying flow path that supplies the liquid toward the liquid ejecting head, a pump that is provided in the first liquid supplying flow path and feeds the liquid to a downstream side where the liquid ejecting head is located, a second liquid supplying flow path having one end connected to an upstream connecting portion located on an upstream side relative to the pump in the first liquid supplying flow path and the other end connected to a downstream connecting portion located on a downstream side relative to the pump, the second liquid supplying flow path together with the first liquid supplying flow path forms a circulation flow path in which the liquid circulates, a pressure control valve disposed in the second liquid supplying flow path, a buffer in which a volume of a storage chamber that stores the liquid varies by displacement of a flexible member, and a pressure applying section that applies pressure to the flexible member from an outside of the storage chamber, wherein the buffer is disposed at least one of a position on a downstream side relative to the pump in the first liquid supplying flow path and a position that is closer to the downstream connecting portion than the pressure control valve is in the second liquid supplying flow path, and the pressure control valve opens when a pressure in the buffer becomes a predetermined pressure or higher.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an embodiment of a liquid ejecting apparatus will be described. The liquid ejecting apparatus is, for example, an ink jet printer that performs recording (printing) by ejecting ink which is an example of liquid onto a medium such as a paper sheet.

Figure 1:
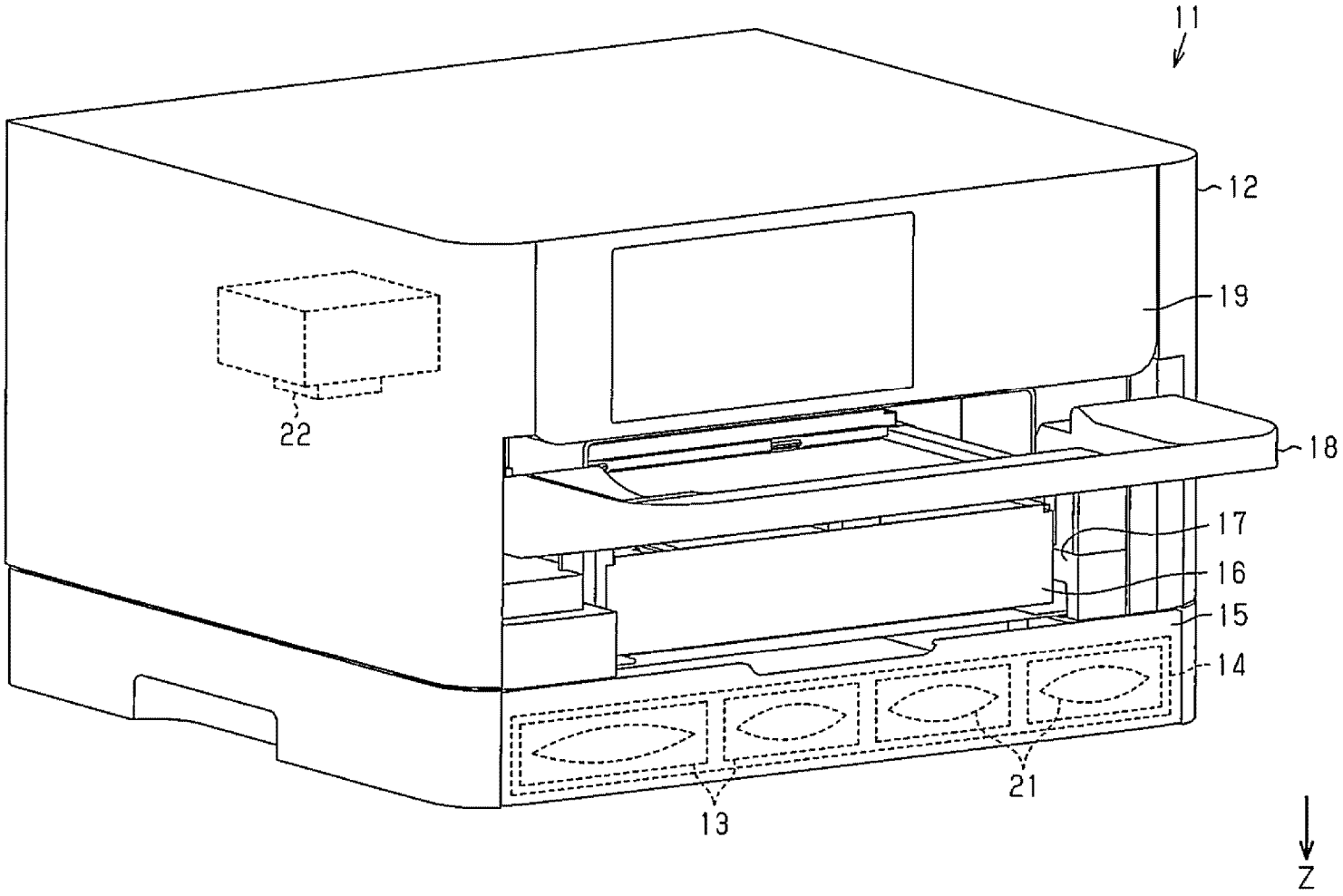
FIG. 1 is a perspective view of one embodiment of a liquid ejecting apparatus.

As shown in FIG. 1, a liquid ejecting apparatus 11 includes an outer casing 12 of a substantially cuboid shape. In the drawings, assuming that the liquid ejecting apparatus 11 is placed on a horizontal surface, a gravitational direction indicated by the Z axis is defined as a vertical direction Z. A side surface of the outer casing 12 on which operations to the liquid ejecting apparatus 11 are performed is defined as a front surface.

On the front surface of the outer casing 12, a front cover 15 that rotatably covers a mounting section 14 to which a container 13 is detachably attached, and a mounting port 17 in which a medium storage 16 for storing a medium (not shown in the figure) such as a paper sheet is mounted are disposed in this order from the bottom. A medium output tray 18 through which a medium is output, and an operation panel 19 for operating the liquid ejecting apparatus 11 are disposed above the mounting port 17.

One or more (in this embodiment, four) containers 13 can be mounted in the mounting section 14. In each container 13, a liquid supply source 21 such as a liquid storage for storing liquid is detachably mounted. Each liquid supply source 21 stores different types of liquid (for example, different color ink such as black, cyan, magenta, yellow, and the like) and serves as a liquid supply source for a liquid ejecting head 22.

Figure 2:
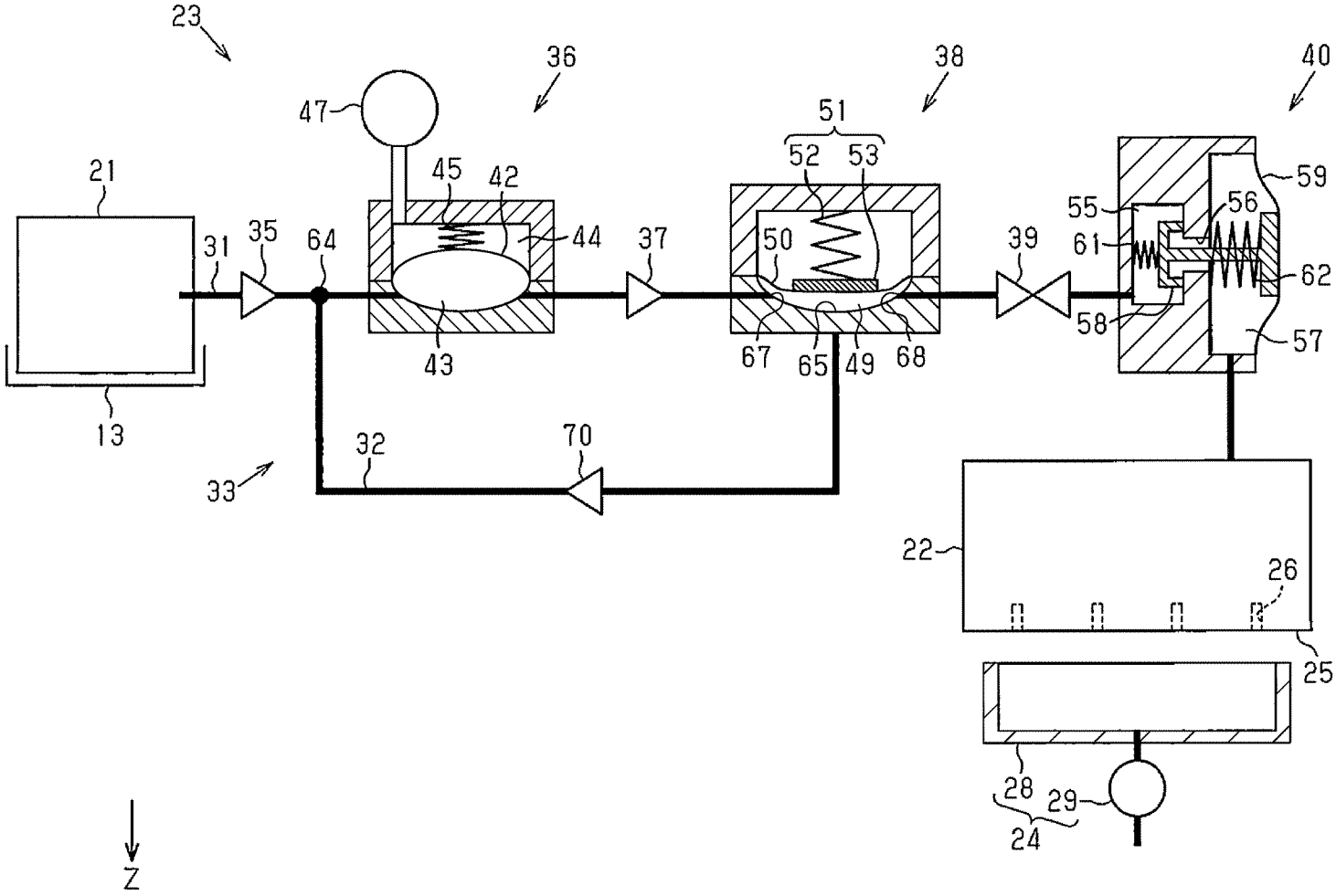
FIG. 2 is a schematic diagram of a supply device that supplies liquid from a liquid supply source to a liquid ejecting head.

As shown in FIG. 2, the liquid ejecting apparatus 11 includes the liquid ejecting head 22 that ejects liquid, a supply device 23 that supplies liquid from the liquid supply source 21 to the liquid ejecting head 22, and a maintenance device 24 that performs maintenance of the liquid ejecting head 22. A plurality of nozzles 26 that ejects liquid is formed on a nozzle forming surface 25 of the liquid ejecting head 22.

The maintenance device 24 includes a cap 28 that receives liquid discharged from the nozzles 26, and a suction mechanism 29 that suctions an inside of the cap 28. The cap 28 is in contact with the liquid ejecting head 22 to form a closed space between the cap 28 and the nozzle forming surface 25 to which the nozzles 26 are open, and caps the liquid ejecting head 22.

Next, the supply device 23 will be described. The liquid ejecting apparatus 11 includes one or more (in this embodiment, four) supply devices 23 for each type of liquid ejected from the liquid ejecting head 22. For example, when the liquid ejecting apparatus 11 is a printer, the supply devices 23 are provided for each of the ink colors. The liquid ejecting apparatus 11 of the present embodiment includes the same number of the supply devices 23 as that of the containers 13 that can be mounted in the mounting sections 14, and the supply devices 23 have the same configuration. Therefore, one of the supply devices 23 will be described, and duplicated description will be omitted by giving the same reference numbers.

As shown in FIG. 2, the supply device 23 includes a first liquid supplying flow path 31 that supplies liquid from the liquid supply source 21 to the liquid ejecting head 22, and a second liquid supplying flow path 32 connected to the first liquid supplying flow path 31. The second liquid supplying flow path 32 together with the first liquid supplying flow path 31 forms a circulation flow path 33 in which liquid circulates. In the following description, an end of the first liquid supplying flow path 31 connected to the liquid supply source 21 is referred to as an upstream side, and an end of the first liquid supplying flow path 31 connected to the liquid ejecting head 22 is referred to as a downstream side.

An upstream check valve 35, a pump 36, a downstream check valve 37, a buffer 38, an on-off valve 39, and a pressure regulating valve 40 are disposed in the first liquid supplying flow path 31 in this order from the upstream side. The upstream check valve 35 and the downstream check valve 37 permit the flow of liquid directed from the upstream side to the downstream side in the first liquid supplying flow path 31, and limits the flow directed from the downstream side to the upstream side. The upstream check valve 35 is disposed at a position on the upstream side to the pump 36 and between the liquid supply source 21 and the pump 36 in the first liquid supplying flow path 31. The downstream check valve 37 is disposed at a position on the downstream side to the pump 36 and between the pump 36 and the buffer 38 in the first liquid supplying flow path 31.

The pump 36 is a diaphragm pump that moves a flexible diaphragm 42 in a reciprocating manner and applies pressure to the liquid. The pump 36 includes a pump chamber 43 and a negative pressure chamber 44 separated by the diaphragm 42, and a first bias member 45 which is disposed in the negative pressure chamber 44 and biases the diaphragm 42 toward the pump chamber 43. The pump chamber 43 constitutes part of the first liquid supplying flow path 31.

The liquid ejecting apparatus 11 includes a driving source 47 that drives the pump 36. The driving source 47 reduces the pressure in the negative pressure chamber 44 and increases a volume of the pump chamber 43 against the biasing force of the first bias member 45. Accordingly, the pump 36 suctions liquid into the pump chamber 43. As the driving source 47 releases the pressure reduction in the negative pressure chamber 44, the first bias member 45 biases the diaphragm 42 to thereby reduce the volume of the pump chamber 43. Accordingly, the pump 36 ejects the liquid stored in the pump chamber 43. The pump 36 alternately performs suction driving by which liquid is suctioned into the pump chamber 43 and ejection driving by which liquid is ejected from the pump chamber 43 so that liquid is fed from the upstream side where the liquid supply source 21 is located to the downstream side where the liquid ejecting head 22 is located.

The buffer 38 is disposed at a position on the downstream side to the pump 36 in the first liquid supplying flow path 31. The buffer 38 includes a storage chamber 49 that stores liquid, a flexible member 50 that forms part of the wall of the storage chamber 49, and a pressure applying section 51 that applies pressure to the flexible member 50 from outside the storage chamber 49. The storage chamber 49 constitutes part of the first liquid supplying flow path 31.

The pressure applying section 51 includes a second bias member 52 that biases the flexible member 50 in a direction by which the volume of the storage chamber 49 decreases, and a pressure receiving member 53 disposed between the second bias member 52 and the flexible member 50. The buffer 38 displaces the flexible member 50 to change the volume of the storage chamber 49 to thereby mitigate pressure change of the liquid. The pressure applying section 51 applies pressure to the liquid stored in the storage chamber 49, and supplies liquid from the storage chamber 49.

The pressure regulating valve 40 includes a supplying chamber 55 to which liquid is supplied, a pressure chamber 57 that can communicate with the supplying chamber 55 via a communication hole 56, and a valve body 58 that can close and open the communication hole 56. Part of the wall of the pressure chamber 57 is formed by a flexible wall 59 that can be flexibly displaced. The supplying chamber 55, the communication hole 56, and the pressure chamber 57 constitute part of the first liquid supplying flow path 31.

The pressure regulating valve 40 includes an upstream bias member 61 accommodated in the supplying chamber 55, and a downstream bias member 62 accommodated in the pressure chamber 57. The upstream bias member 61 and the downstream bias member 62 bias the valve body 58 in the direction by which the communication hole 56 is closed. The pressure regulating valve 40 may be configured to have one of the upstream bias member 61 and the downstream bias member 62.

As shown in FIG. 2, one end of the second liquid supplying flow path 32 is connected to an upstream connecting portion 64 located on the upstream side to the pump 36 in the first liquid supplying flow path 31, and the other end is connected to a downstream connecting portion 65 located on the downstream side to the pump 36. Specifically, the upstream connecting portion 64 is located between the upstream check valve 35 and the pump 36 in the first liquid supplying flow path 31, and the downstream connecting portion 65 is disposed in the buffer 38. That is, the second liquid supplying flow path 32 is connected to the storage chamber 49 of the buffer 38. The circulation flow path 33 is made up of the first liquid supplying flow path 31 between the upstream connecting portion 64 and the downstream connecting portion 65, and the second liquid supplying flow path 32. Further, the pump 36 is located in the circulation flow path 33.

The downstream connecting portion 65 is located at a position lower than an inlet port 67 in the buffer 38 and an outlet port 68 in the buffer 38 in the vertical direction Z. The inlet port 67 is a port that allows inflow of liquid fed from the pump 36, and the outlet port 68 is a port that allows outflow of liquid flowing toward the liquid ejecting head 22. The inlet port 67, the outlet port 68, and the downstream connecting portion 65 are openings formed in the storage chamber 49.

The second liquid supplying flow path 32 is provided with a pressure control valve 70. The pressure control valve 70 is a differential pressure valve that opens the second liquid supplying flow path 32 based on a difference between the pressure on the side close to the upstream connecting portion 64 relative to the pressure control valve 70 and the pressure on the side that is closer to the downstream connecting portion 65 than the pressure control valve 70 is in the second liquid supplying flow path 32. Specifically, the pressure control valve 70 opens when the pressure on the side close to the downstream connecting portion 65 is higher than the pressure on the side close to the upstream connecting portion 64, and the pressure in the buffer 38 becomes higher than a predetermined pressure. The predetermined pressure is higher than a water head pressure applied to the upstream connecting portion 64, and higher than an ejection pressure of the pump 36.

The second bias member 52 of the present embodiment is a compression coil spring, which applies the maximum biasing force when it is most contracted and the minimum biasing force when it is most expanded. In the buffer 38, the pressure applied to the liquid when the flexible member 50 is biased by the second bias member 52 with the maximum biasing force is referred to as a maximum pressure, and the pressure applied to the liquid when the flexible member 50 is biased by the second bias member 52 with the minimum biasing force is referred to as a minimum pressure.

The maximum pressure is a pressure when the storage chamber 49 has the maximum volume, and the minimum pressure is a pressure when the storage chamber 49 has the minimum volume. The minimum pressure is higher than the pressure required to supply liquid from the buffer 38 to the liquid ejecting head 22. The predetermined pressure that opens the pressure control valve 70 is lower than the maximum pressure and higher than the minimum pressure.

The biasing force of the second bias member 52 is smaller than the biasing force of the first bias member 45. Accordingly, when liquid is fed from the pump 36 by the biasing force of the first bias member 45, the volume of the storage chamber 49 increases against the biasing force of the second bias member 52 in the buffer 38. As the volume of the storage chamber 49 increases, the second bias member 52 is contracted while increasing the biasing force. When the volume of the storage chamber 49 becomes a predetermined volume, the pressure control valve 70 opens.

Figure 3:
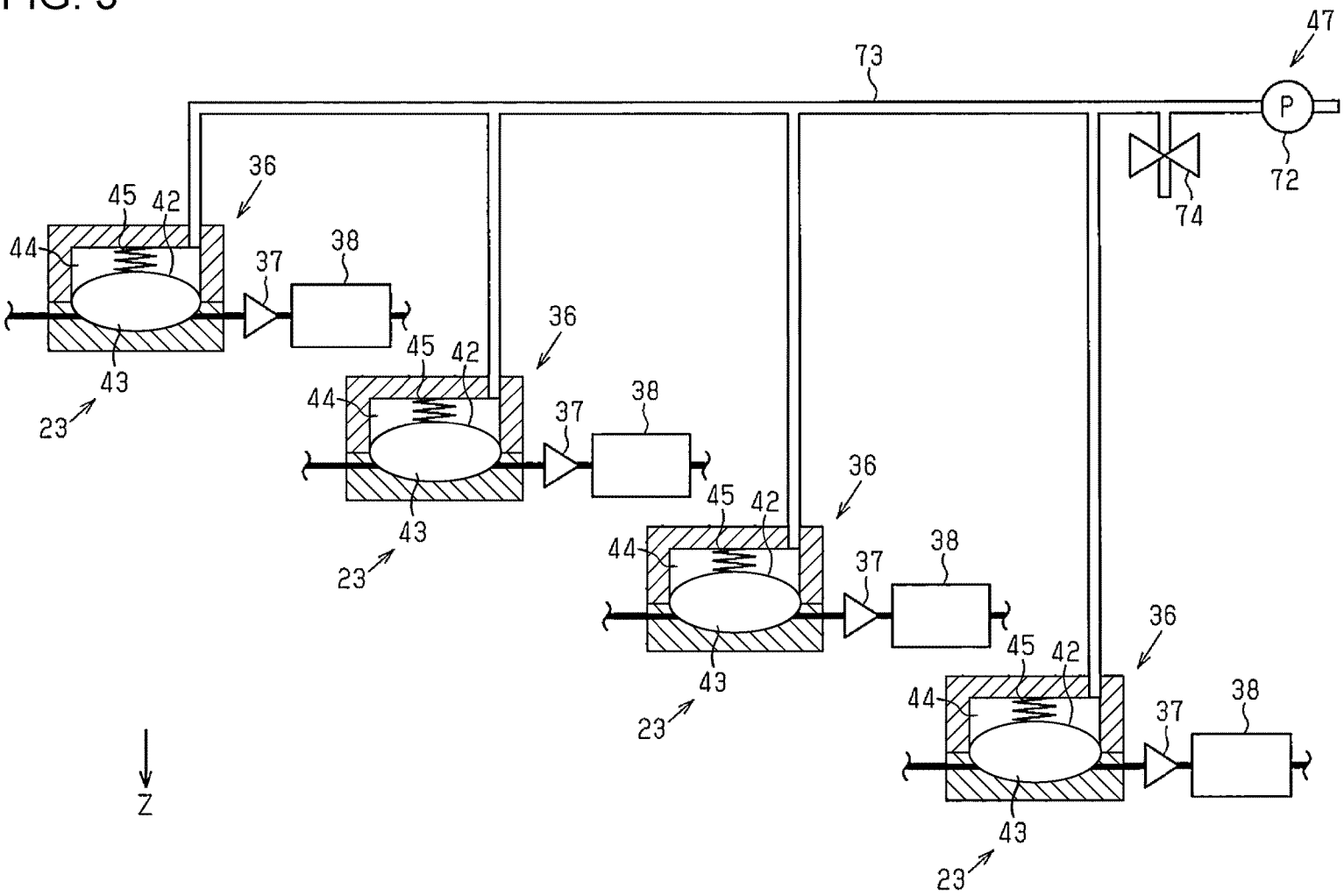
FIG. 3 is a schematic diagram of a driving source.

As shown in FIG. 3, the driving source 47 includes a pressure reducing portion 72 that reduces the pressure of a fluid such as air, a connection path 73 that connects the pressure reducing portion 72 to the negative pressure chambers 44, and an air release portion 74 provided in the connection path 73. The downstream portion of the connection path 73 is branched into a plurality of (in this embodiment, four) paths, each of which is connected to the pump 36 of each supply device 23.

The pressure reducing portion 72 collectively reduces the pressure of a plurality of negative pressure chambers 44 via the connection path 73, and the air release portion 74 opens the connection path 73 to the atmosphere so as to collectively open the plurality of negative pressure chambers 44 to the atmosphere. That is, the driving source 47 simultaneously drives a plurality of pumps 36. The term simultaneously as used herein includes variation in start and end of driving due to a flow path resistance or the like in the connection path 73, and refers a state where at least part of suction driving or at least part of ejection driving of the respective pumps 36 overlap to each other.

Next, effects of the liquid ejecting apparatus 11 will be described. The first liquid supplying flow path 31, the second liquid supplying flow path 32, and the liquid ejecting head 22 are assumed to be filled with liquid.

As shown in FIGS. 2 and 3, the driving source 47 drives the pumps 36 of at least two supply devices 23 among a plurality of supply devices 23 until the pressure of at least two buffers 38 of at least two supply devices 23 becomes a predetermined pressure. The driving source 47 of the present embodiment drives all (four) pumps 36 of the plurality of (four) supply devices 23 until the pressure of all (four) buffers 38 becomes a predetermined pressure and all (four) pressure control valves 70 open.

When the pressure control valve 70 opens, liquid flows from the downstream connecting portion 65 to the upstream connecting portion 64 in the second liquid supplying flow path 32. That is, liquid circulates in the circulation flow path 33. When liquid contains precipitating components such as pigments, the liquid is stirred by circulation to thereby suppress uneven concentration. Since the downstream connecting portion 65 is located at a position lower than the inlet port 67 in the vertical direction Z, highly concentrated liquid is allowed to efficiently flow.

When the liquid ejecting head 22 ejects liquid, the pressure regulating valve 40 supplies liquid stored in the pressure chamber 57 to the liquid ejecting head 22. When the internal pressure of the pressure chamber 57 decreases and a force of the flexible wall 59 pushing the valve body 58 exceeds the biasing force of the upstream bias member 61 and the downstream bias member 62, the valve body 58 opens the communication hole 56.

As the communication hole 56 opens, liquid flows from the supplying chamber 55 into the pressure chamber 57, and liquid stored in the storage chamber 49 flows into the supplying chamber 55. When the pressure in the storage chamber 49 becomes lower than a predetermined pressure, the pressure control valve 70 closes the second liquid supplying flow path 32. When the internal pressure of the pressure chamber 57 increases, the pressure regulating valve 40 causes the valve body 58 to close the communication hole 56 by the biasing force of the upstream bias member 61 and the downstream bias member 62.

In the case where the amount of liquid fed by the pump 36 is larger than the amount of liquid consumed by the liquid ejecting head 22 per unit time, the liquid remains stored in the buffer 38. Particularly, in the liquid ejecting apparatus 11 having a plurality of supply devices 23, when the consumption amount of a specific liquid is large such as the case of monochrome printing, liquid needs to be supplied in line with the liquid largely consumed. As a consequence, in the supply device 23 that supplies the liquid which is less consumed, storage amount in the buffer 38 is increased. In this case as well, since the supply device 23 having the buffer 38 in which the pressure in the storage chamber 49 becomes larger than the predetermined pressure causes the pressure control valve 70 to open the second liquid supplying flow path 32, an increase in pressure in the buffer 38 is reduced.

The maintenance device 24 performs cleaning, which is a maintenance operation for discharging liquid from the nozzles 26 to thereby discharge foreign substances such as air bubbles. The cleaning includes several types such as suction cleaning and choke cleaning.

The suction cleaning is performed by driving the suction mechanism 29 while the liquid ejecting head 22 is capped. The suction cleaning discharges foreign substances such as air bubbles in the liquid ejecting head 22 from the nozzles 26 along with liquid.

The choke cleaning is performed by driving the suction mechanism 29 while the liquid ejecting head 22 is capped and the on-off valve 39 is closed. In the choke cleaning, negative pressure is applied to an area from the nozzles 26 to the on-off valve 39 while the driving source 47 drives the pump 36 to store liquid in the storage chamber 49.

In some cases, air bubbles are contained in liquid. Since the downstream connecting portion 65 is located at a position lower than the inlet port 67 in the vertical direction Z, air bubbles are less likely to flow into the second liquid supplying flow path 32 and tend to be accumulated in the buffer 38 even if liquid circulates in the circulation flow path 33.

Then, when the on-off valve 39 opens, the negative pressure accumulated between the on-off valve 39 and the nozzles 26 and the biasing force by the second bias member 52 urges the liquid stored in the buffer 38 to flow toward the liquid ejecting head 22. Since the outlet port 68 is located above the downstream connecting portion 65, air bubbles in the buffer 38 flows along with liquid toward the liquid ejecting head 22.

According to the aforementioned embodiment, the following effects can be obtained.

(1) Since the pressure control valve 70 opens when the pressure in the buffer 38 becomes a predetermined pressure or higher, liquid can be returned to the upstream side relative to the pump 36 via the second liquid supplying flow path 32. Accordingly, pressure can be released when the pressure in the buffer 38 increases to thereby limit an increase in pressure in the buffer 38.

(2) Since the buffer 38 is disposed in the first liquid supplying flow path 31, liquid stored in the buffer 38 can be smoothly supplied to the liquid ejecting head 22 compared to the case where the buffer 38 is disposed in the second liquid supplying flow path 32.

(3) Since the downstream connecting portion 65 is disposed in the buffer 38, the downstream connecting portion 65 can be integrally formed with the buffer 38.

(4) Some liquid may contain components which precipitate as time elapses, which causes uneven concentration. In this regard, since the downstream connecting portion 65 is located at a position lower than the inlet port 67 in the vertical direction Z, highly concentrated liquid can be stirred by flowing into the second liquid supplying flow path 32.

(5) The downstream connecting portion 65 is located at a position lower than the outlet port 68 in the vertical direction Z. As a result, a risk that air bubbles flow in the second liquid supplying flow path 32 can be reduced even if air bubbles are generated in liquid.

(6) Since the downstream check valve 37 is disposed in the first liquid supplying flow path 31, a liquid flow directed from the buffer 38 to the pump 36 in the first liquid supplying flow path 31 is limited. As a result, the amount of liquid in the buffer 38 can be stabilized.

(7) Since the upstream check valve 35 is disposed in the first liquid supplying flow path 31, a liquid flow directed from the pump 36 to the liquid supply source 21 is limited. As a result, a backflow of liquid can be suppressed.

(8) Since a predetermined pressure at which the pressure control valve 70 opens is higher than the water head pressure applied to the upstream connecting portion 64, liquid can flow from the downstream connecting portion 65 to the upstream connecting portion 64 in the second liquid supplying flow path 32 when the pressure control valve 70 opens. As a result, an increase in pressure in the buffer 38 can be limited.

(9) The driving source 47 drives the pump 36 until the pressure in at least two buffers 38 becomes a predetermined pressure. Accordingly, in the supply device 23 in which the pressure in the buffer 38 first becomes a predetermined pressure, the pump 36 is driven until the buffer 38 of the other supply device 23 becomes the predetermined pressure, while the pressure in the buffer 38 can be released via the second liquid supplying flow path 32. Accordingly, even if the pumps 36 of the plurality of supply devices 23 are driven by a single driving source 47, liquid can be fed in a stable manner.

(10) Since the storage chamber 49 stores liquid, liquid containing precipitating components tends to have uneven concentration in the storage chamber 49. In this regard, since the storage chamber 49 constitutes part of the circulation flow path 33, liquid can be efficiently stirred.

The above embodiment may be changed as described in the following modified examples. Any combination of the above embodiment and the modified example described below or any combination of each of the modified examples can also be used.

Figure 4:
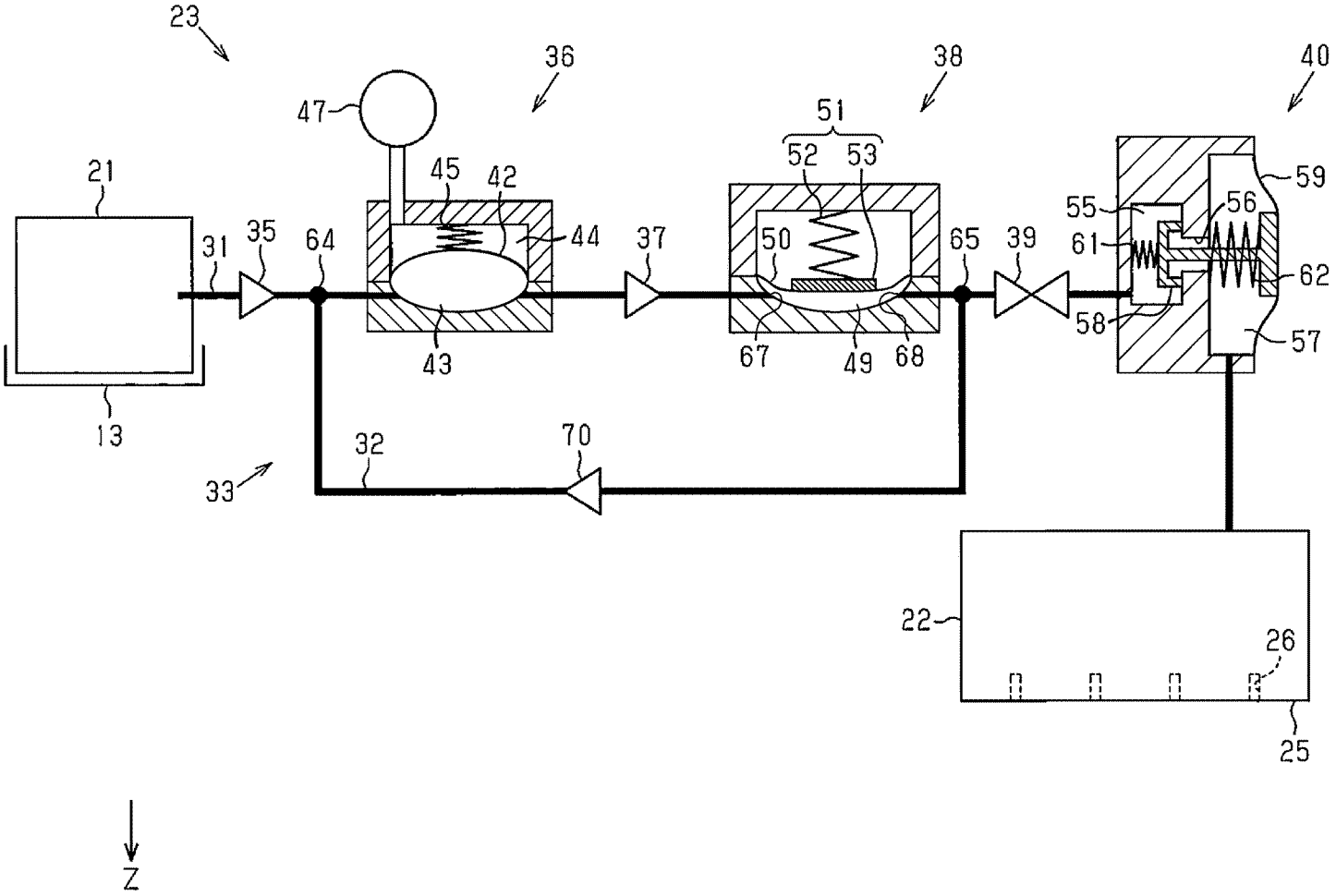
FIG. 4 is a schematic diagram of a supply device of a first modified example.

As shown in FIG. 4, the downstream connecting portion 65 may be disposed at a position between the buffer 38 and the on-off valve 39 in the first liquid supplying flow path 31 (first modified example).

Figure 5:
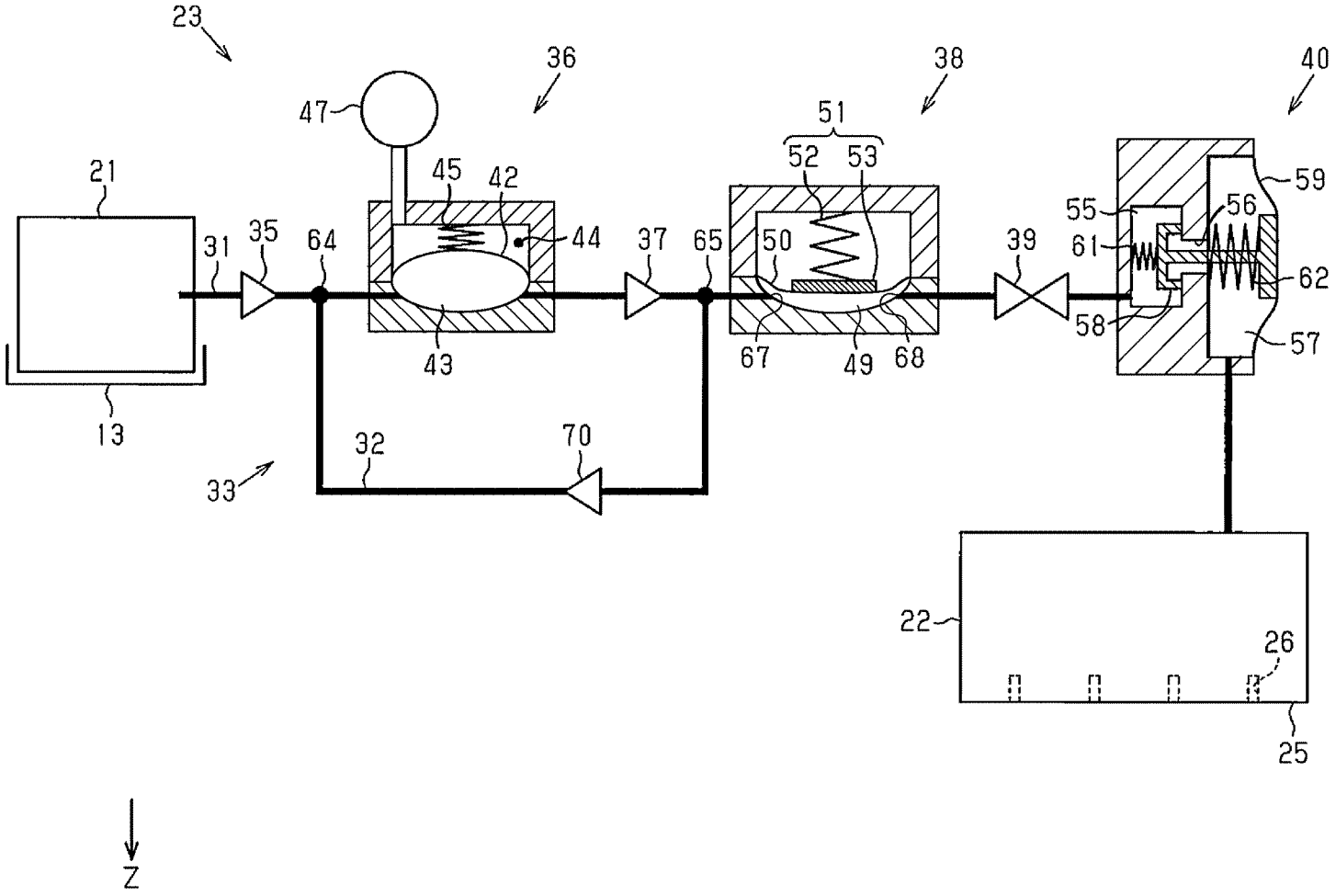
FIG. 5 is a schematic diagram of a supply device of a second modified example.

As shown in FIG. 5, the downstream connecting portion 65 may be disposed at a position between the downstream check valve 37 and the buffer 38 in the first liquid supplying flow path 32 (second modified example).

Figure 6:
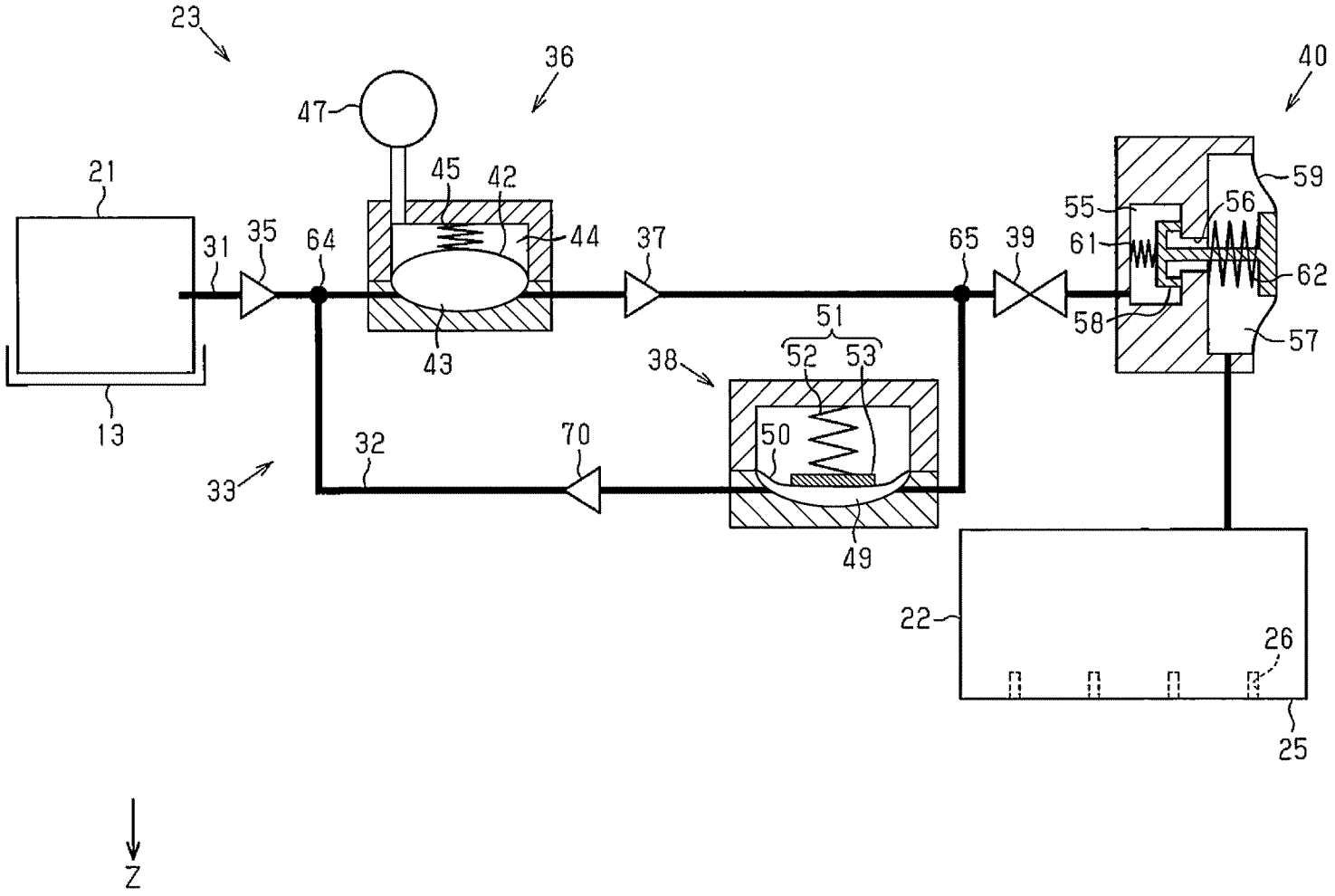
FIG. 6 is a schematic diagram of a supply device of a third modified example.

As shown in FIG. 6, the buffer 38 may be disposed at a position that is closer to the downstream connecting portion 65 than the pressure control valve 70 is in the second liquid supplying flow path 32 (third modified example). The downstream connecting portion 65 is preferably disposed at a position between the downstream check valve 37 and the on-off valve 39 in the first liquid supplying flow path 31.

The supply device 23 may include a plurality of buffers 38. For example, the buffers 38 may be disposed at a position on the downstream side relative to the pump 36 in the first liquid supplying flow path 31, and a position that is closer to the downstream connecting portion 65 than the pressure control valve 70 is in the second liquid supplying flow path 32.

The upstream connecting portion 64 may be disposed at a position between the liquid supply source 21 and the upstream check valve 35 in the first liquid supplying flow path 31. The upstream connecting portion 64 may be disposed in the liquid supply source 21.

The supply device 23 may not necessarily include the on-off valve 39.

The supply device 23 that supplies liquid containing precipitating components may drive the pump 36 independently from the liquid consumption in the liquid ejecting head 22. For example, the supply device 23 may drive the pump 36 for stirring liquid and circulate the liquid.

The liquid ejecting apparatus 11 may be configured to include one supply device 23.

The driving source 47 may drive the pump 36 until the pressure in at least two buffers 38 among a plurality of supply devices 23 becomes a predetermined pressure. For example, the driving source 47 may drive the pump 36 until the pressure in two or three buffers 38 among four supply devices 23 becomes a predetermined pressure.

The supply device 23 may include the driving source 47. That is, even if the liquid ejecting apparatus 11 includes the plurality of supply devices 23, the driving source 47 may be disposed for each of the supply devices 23.

The driving source 47 may drive the pump 36 of some of the supply devices 23 among the plurality of supply devices 23 included in the liquid ejecting apparatus 11. For example, the liquid ejecting apparatus 11 may include four supply devices 23 and two driving sources 47, and each driving source 47 may drive the pump 36 in each of the two supply devices 23.

The predetermined pressure at which the pressure control valve 70 opens may be the water head pressure applied to the upstream connecting portion 64 or lower.

The pump 36 can be changed as appropriate as long as it feeds liquid from the upstream side to the downstream side. For example, the pump 36 may be a mechanical diaphragm pump that moves the diaphragm 42 by using a cam or the like. The pump 36 may be a pressure diaphragm pump which includes the pump chamber 43 and a pressure chamber separated by the diaphragm 42 and configured to pump liquid by applying pressure to the pressure chamber. The pump 36 may be a reciprocating pump such as a diaphragm pump and a piston pump, a rotation pump such as a gear pump and screw pump, or a tube pump. When the pump 36 is a rotation pump or a tube pump, the supply device 23 may not necessarily include the upstream check valve 35 and the downstream check valve 37.

The downstream connecting portion 65 may be located at the same position as the outlet port 68 in the vertical direction Z in the storage chamber 49, or a position higher than the outlet port 68.

The downstream connecting portion 65 may be located at the same position as the inlet port 67 in the vertical direction Z in the storage chamber 49, or a position higher than the inlet port 67. When the downstream connecting portion 65 is located at a position higher than the inlet port 67, liquid can be flowed to suspend the precipitated components therein even if the liquid contains the precipitated components in the storage chamber 49.

The outlet port 68 and the inlet port 67 may be located at different positions in the vertical direction Z. For example, the outlet port 68 may be located at a position higher than the inlet port 67 in the vertical direction Z, or the inlet port 67 may be located at a position higher than the outlet port 68 in the vertical direction Z.

The liquid supply source 21 may have any configuration as long as it can store liquid, and may be, for example, a cartridge type that can be replaced or a tank type that can be refilled with liquid. The liquid supply source 21 may be a sub-supply source that temporarily stores liquid supplied from a main supply source having a large storage volume. When the liquid supply source 21 is a cartridge type, the liquid ejecting apparatus 11 preferably holds a liquid supply source in a detachable manner. When the liquid supply source 21 is a tank type, the liquid ejecting apparatus 11 preferably holds a liquid supply source in a non-detachable manner.

The liquid may include materials in liquid phase such as liquid having high or low viscosity, sol, gel water, other inorganic solvent, organic solvent and liquid solution, and a material in a flowable state such as liquid resin and liquid metal (molten metal). Further, in addition to materials in a liquid state, particles of a functional material made of solid substance such as pigment and metal particles, which are dissolved, dispersed or mixed in a solvent. Typical examples of the liquid include ink. The ink as described herein includes various liquid components such as general water-based ink, oil-based ink, gel ink and hot melt ink.

Technical ideas achieved by the above embodiment and modified examples and their advantageous effects will be described below.

Idea 1

A liquid ejecting apparatus including: a liquid ejecting head that ejects liquid; and a supply device that supplies the liquid from a liquid supply source to the liquid ejecting head, the supply device including: a first liquid supplying flow path that supplies the liquid toward the liquid ejecting head; a pump that is provided in the first liquid supplying flow path and feeds the liquid to a downstream side where the liquid ejecting head is located; a second liquid supplying flow path having one end connected to an upstream connecting portion located on an upstream side relative to the pump in the first liquid supplying flow path and the other end connected to a downstream connecting portion located on a downstream side relative to the pump, the second liquid supplying flow path together with the first liquid supplying flow path forms a circulation flow path in which the liquid circulates; a pressure control valve disposed in the second liquid supplying flow path; a buffer in which a volume of a storage chamber that stores the liquid varies by displacement of a flexible member; and a pressure applying section that applies pressure to the flexible member from an outside of the storage chamber, wherein the buffer is disposed at least one of a position on a downstream side relative to the pump in the first liquid supplying flow path and a position that is closer to the downstream connecting portion than the pressure control valve is in the second liquid supplying flow path, and the pressure control valve opens when a pressure in the buffer becomes a predetermined pressure or higher.

With this configuration, liquid can be returned to the upstream side relative to the pump via the second liquid supplying flow path since the pressure control valve opens when the pressure in the buffer becomes a predetermined pressure or higher. Accordingly, pressure can be released when the pressure in the buffer increases to thereby limit an increase in pressure in the buffer.

Idea 2

The liquid ejecting apparatus according to the above idea 1, wherein the buffer is provided in the first liquid supplying flow path.

With this configuration, liquid stored in the buffer can be smoothly supplied to the liquid ejecting head compared to the case where the buffer is disposed in the second liquid supplying flow path since the buffer is disposed in the first liquid supplying flow path.

Idea 3

The liquid ejecting apparatus according to the above idea 2, wherein the downstream side connecting section is provided in the buffer.

With this configuration, the downstream connecting portion can be integrally formed with the buffer since the downstream connecting portion is disposed in the buffer.

Idea 4

The liquid ejecting apparatus according to the above idea 3, wherein the downstream connecting portion is provided at a position lower than an inlet port in the buffer in a vertical direction, the inlet port being a port that allows inflow of the liquid fed from the pump.

Some liquid may contain components which precipitate as time elapses, which causes uneven concentration. In this regard, according to this configuration, highly concentrated liquid can be stirred by flowing into the second liquid supplying flow path since the downstream connecting portion is located at a position lower than the inlet port in the vertical direction.

Idea 5

The liquid ejecting apparatus according to the above idea 3 or 4, wherein the downstream connecting portion is provided at a position lower than an outlet port in the buffer in a vertical direction, the outlet port being a port that allows an outflow of the liquid toward the liquid ejecting head.

With this configuration, the downstream connecting portion is located at a position lower than the outlet port in the vertical direction. As a result, a risk that air bubbles flow in the second liquid supplying flow path can be reduced even if air bubbles are generated in liquid.

Idea 6

The liquid ejecting apparatus according to any one of the above ideas 2 to 5, wherein a downstream check valve is provided at a position on a downstream side relative to the pump and between the pump and the buffer in the first liquid supplying flow path, the downstream check valve permitting a flow of the liquid directed to a downstream side and limiting a flow directed to an upstream side.

With this configuration, a liquid flow directed from the buffer to the pump in the first liquid supplying flow path is limited since the downstream check valve is disposed in the first liquid supplying flow path. As a result, the amount of liquid in the buffer can be stabilized.

Idea 7

The liquid ejecting apparatus according to any one of the above ideas 1 to 6, wherein an upstream check valve is provided at a position on an upstream side relative to the pump and between the liquid supply source and the pump in the first liquid supplying flow path, the upstream check valve permitting a flow of the liquid directed to a downstream side and limiting a flow directed to an upstream side.

With this configuration, a liquid flow directed from the pump to the liquid supply source is limited since the upstream check valve is disposed in the first liquid supplying flow path. As a result, a backflow of liquid can be suppressed.

Idea 8

The liquid ejecting apparatus according to any one of the above ideas 1 to 7, wherein the predetermined pressure is higher than a water head pressure applied to the upstream connecting portion.

With this configuration, liquid can flow from the downstream connecting portion to the upstream connecting portion in the second liquid supplying flow path when the pressure control valve opens since a predetermined pressure at which the pressure control valve opens is higher than the water head pressure applied to the upstream connecting portion. As a result, an increase in pressure in the buffer can be limited.

Idea 9

The liquid ejecting apparatus according to any one of the above ideas 1 to 8, including a plurality of the supply devices, wherein a driving source that drives the pump drives the pumps of at least two supply devices among the plurality of supply devices until a pressure of at least two buffers of the at least two supply devices becomes a predetermined pressure.

With this configuration, the driving source drives the pump until the pressure in at least two buffers becomes a predetermined pressure. Accordingly, in the supply device in which the pressure in the buffer first becomes a predetermined pressure, the pump is driven until the buffer of the other supply device becomes the predetermined pressure, while the pressure in the buffer can be released via the second liquid supplying flow path. As a result, liquid can be fed in a stable manner even if the pumps of the plurality of supply devices are driven by a single driving source.

The entire disclosure of Japanese Patent Application No. 2017-093697, filed May 10, 2017 is expressly incorporated by reference herein.

What is claimed is:

1. A liquid ejecting apparatus comprising:

a liquid ejecting head that ejects liquid; and a supply device that supplies the liquid from a liquid supply source to the liquid ejecting head, the supply device including:

a first liquid supplying flow path that supplies the liquid toward the liquid ejecting head;

a pump that is provided in the first liquid supplying flow path and feeds the liquid to a downstream side where the liquid ejecting head is located;

a second liquid supplying flow path having one end connected to an upstream connecting portion located on an upstream side relative to the pump in the first liquid supplying flow path and the other end connected to a downstream connecting portion located on a downstream side relative to the pump, the second liquid supplying flow path together with the first liquid supplying flow path forms a circulation flow path in which the liquid circulates;

a pressure control valve disposed in the second liquid supplying flow path;

a buffer in which a volume of a storage chamber that stores the liquid varies by displacement of a flexible member; and a pressure applying section that applies pressure to the flexible member from an outside of the storage chamber, wherein the buffer is disposed at least one of a position on a downstream side relative to the pump in the first liquid supplying flow path and a position that is closer to the downstream connecting portion than the pressure control valve is in the second liquid supplying flow path, and the pressure control valve opens when a pressure in the buffer becomes a predetermined pressure or higher.

2. The liquid ejecting apparatus according to claim 1, wherein the buffer is provided in the first liquid supplying flow path.

3. The liquid ejecting apparatus according to claim 2, wherein the downstream connecting portion is provided in the buffer.

4. The liquid ejecting apparatus according to claim 3, wherein the downstream connecting portion is provided at a position lower than an inlet port in the buffer in a vertical direction, the inlet port being a port that allows inflow of the liquid fed from the pump.

5. The liquid ejecting apparatus according to claim 3, wherein the downstream connecting portion is provided at a position lower than an outlet port in the buffer in a vertical direction, the outlet port being a port that allows an outflow of the liquid toward the liquid ejecting head.

6. The liquid ejecting apparatus according to claim 2, wherein a downstream check valve is provided at a position on a downstream side relative to the pump and between the pump and the buffer in the first liquid supplying flow path, the downstream check valve permitting a flow of the liquid directed to a downstream side and limiting a flow directed to an upstream side.

7. The liquid ejecting apparatus according to claim 1, wherein an upstream check valve is provided at a position on an upstream side relative to the pump and between the liquid supply source and the pump in the first liquid supplying flow path, the upstream check valve permitting a flow of the liquid directed to a downstream side and limiting a flow directed to an upstream side.

8. The liquid ejecting apparatus according to claim 1, wherein the predetermined pressure is higher than a water head pressure applied to the upstream connecting portion.

9. The liquid ejecting apparatus according to claim 1, comprising a plurality of the supply devices, wherein a driving source that drives the pump drives the pumps of at least two supply devices among the plurality of supply devices until a pressure of at least two buffers of the at least two supply devices becomes a predetermined pressure.

* * * * *